US006341566B1

(12) United States Patent
Hwang

(10) Patent No.: US 6,341,566 B1
(45) Date of Patent: Jan. 29, 2002

(54) MOVABLE TYPE FRAME ASSEMBLY

(76) Inventor: Arthur Hwang, 16921 Mt, Gale Cir Fountaw Walley, CA (US) 92708

( * ) Notice: Subject to any disclaimer, the term of this patent is extended or adjusted under 35 U.S.C. 154(b) by 0 days.

(21) Appl. No.: 09/593,063

(22) Filed: Jun. 13, 2000

(51) Int. Cl.[7] ..... A47B 47/00
(52) U.S. Cl. ..... 108/180; 403/171
(58) Field of Search ..... 108/180, 185, 108/190, 192, 193, 106, 153.1, 154, 158.11, 158.12; 403/171, 176, 170

(56) References Cited

U.S. PATENT DOCUMENTS 3,853,074 A * 12/1974 Madey ..... 108/106 X
3,921,360 A * 11/1975 Baldwin ..... 403/171 X
3,955,510 A * 5/1976 Kinik et al. ..... 108/192
4,021,127 A * 5/1977 Gasparro et al. ..... 403/171
4,039,263 A * 8/1977 Bassler ..... 403/171 X
4,630,550 A * 12/1986 Weitzman ..... 108/180 X
4,815,885 A * 3/1989 Wright ..... 403/171 X
5,291,708 A * 3/1994 Johnson ..... 403/171 X
5,556,218 A * 9/1996 Homer ..... 403/171 X
5,678,706 A * 10/1997 Husak et al. ..... 403/171 X
5,839,248 A * 11/1998 Liang ..... 403/171 X

* cited by examiner

*Primary Examiner*—Jose V. Chen
(74) *Attorney, Agent, or Firm*—Rosenberg, Klein & Lee

(57) ABSTRACT

A movable type frame assembly includes upright rods, connecting seats, support rods, and frame bodies. End portions of the connecting seats are provided with insert slots along X, Y, and Z-axes. Each connecting seat is further provided with a vertical insert hole corresponding to a position between two adjacent insert slots. One insert slot of the connecting seat receives a top end of the upright rod. The horizontally insert slots receive support rods such that they make a frame structure. The frame body is placed on the frame structure, and has comer end portions provided with indentations for butting against the connecting seats. Each indentation is provided with a hook for engaging the insert hole of the connecting seat. The vertical insert slots of the connecting seat may receive an additional upright rod or support rod of the same diameter to permit formation of a multiple-tier frame assembly.

5 Claims, 4 Drawing Sheets

MOVABLE TYPE FRAME ASSEMBLY

BACKGROUND OF THE INVENTION a) Field of the Invention

The present invention relates to a movable type frame assembly, and more particularly to a multi-tier frame that utilizes connecting seats to insert connecting upright rods and supporting rods along the X, Y, and Z-axes so that frame body can be supported horizontally, whereas a multiple-tier frame structure can be constructed vertically.

b) Description of the Prior Art

Conventional flowerpot supports include: support rods, transverse rods, straight rods, bases, T-shaped connectors, and cross-shaped connectors. For use, the upright rods are vertically supported on the bases, and the top ends of the support rods are vertically supported on the bases, and top ends of the support rods are connected to the T-shaped or cross-shaped connectors. The transverse rods and straight rods are supported by means of upper supporting recesses at the top ends of the connectors to constitute a frame structure with a supporting function. Planar boards or plates may be placed on top of the frame structure to allow for the placement of flower pots and similar items at a suitable height.

However, the conventional frame assembly as described above can only achieve a one-tier frame structure and can only permit extension or elongation at the same level. If another tier is to be stacked on the conventional frame assembly, the structural strength would not be sufficient. Improvement is, therefore, desirable.

SUMMARY OF THE INVENTION

The object of the present invention is to provide a movable type frame assembly that permits flexibility of spatial construction, and permits formation of a multiple-tier frame assembly, and that has better practical and user convenience. The present invention includes upright rods, connecting seats, support rods, and frame bodies. End portions of the connecting seats are provided with insert slots along X, Y, and Z-axes. Each connecting seat is further provided with a vertical insert hole corresponding to a position between two adjacent insert slots. One insert slot of the connecting seat receives a top end of the upright rod. The horizontal insert slots receive support rods so that they make a frame structure. The frame body is placed on the structure, and has corner end portions providing with indentations for butting against the connecting seats. Each indentation is provided with a hook for engaging the insert hole of the connecting seat. The vertical insert holes of the connecting seat may receive an additional upright rod or support rod of the same diameter to permit formation of a multiple-tier frame assembly.

BRIEF DESCRIPTION OF THE DRAWINGS

The former and other features and advantages of the present invention will be more clearly understood from the following detailed description and the accompanying drawings, in which.

DETAILED DESCRIPTION OF THE PREFERRED EMBODIMENT

Figure 1:
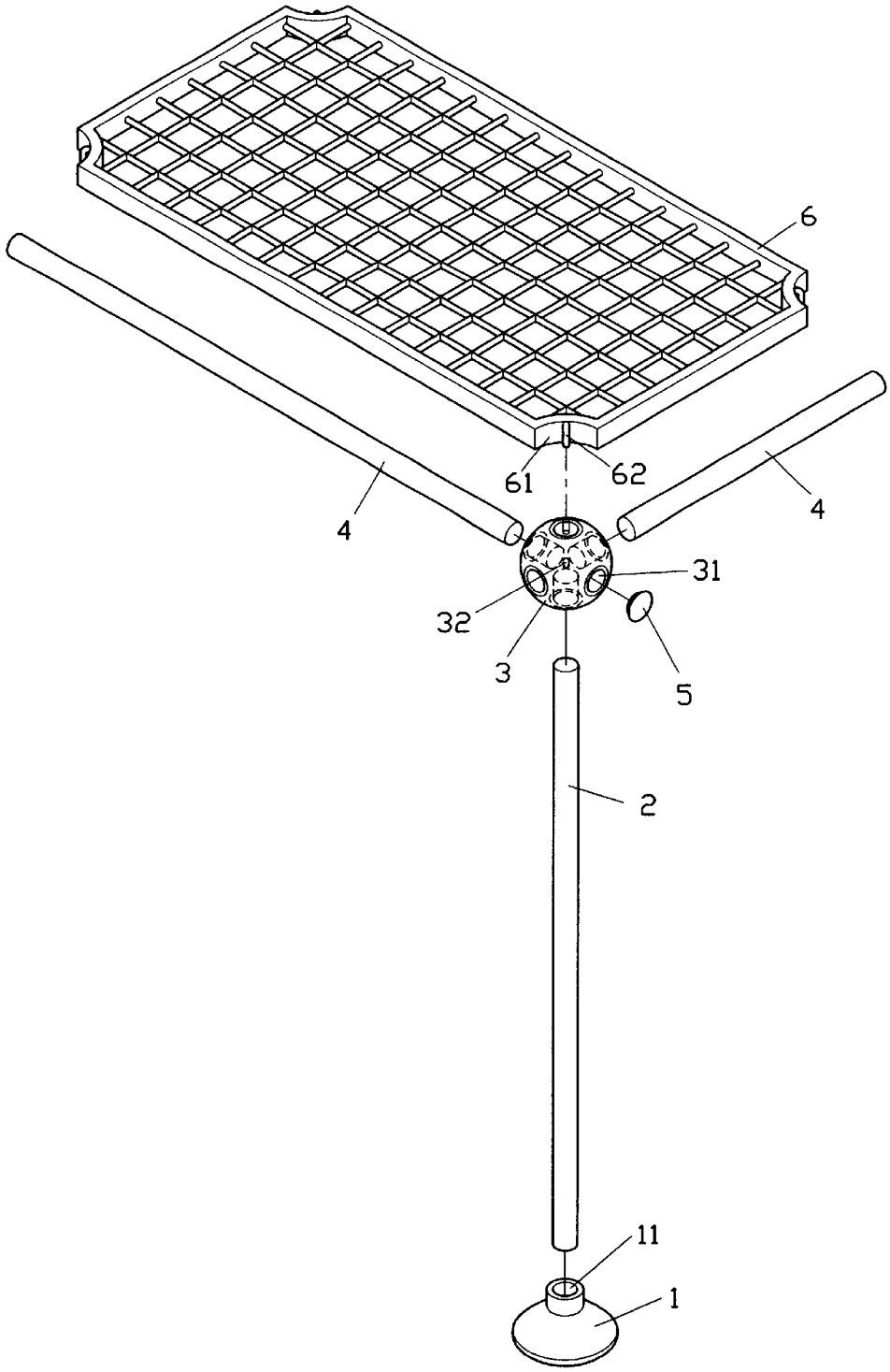
FIG. 1 is an exploded perspective view of the present invention.

With reference to FIG. 1, a preferred embodiment of the present invention includes bases (1), upright rods (2), connecting seats (3), support rods (4), cap plugs (5), and frame bodies (6) with meshing. Each of the bases (1) has a top face and is provided with a vertically oriented hole (11). Each of the upright rods (2) has a diameter corresponding to the diameter of the hole (11), such that the upright rods (2) can be inserted vertically into the hole (11). The upright rods (2) and the support rods (4) may be of the same diameter. The present invention is characterized in that each of the connecting seats (3) is provided with slots (31) on X, Y, and Z-axes, respectively. The surface, top and bottom surfaces are all provided with slots (31), so that there are altogether six slots (31). The top portion of the connecting seat (3) corresponding to the position between two adjacent slots (31) is provided with a vertical insert hole (32). Although the connecting seat (3) illustrated in FIG. 1 has a spherical body, it can be substituted with any other geometrical shape, such as a cube. The cap plugs (5) are plug structures that are formed to correspond to the inner diameter of the insert slots (31) of the connecting seat (3) and that are adapted to seal insert slots (31) where support rods (4) have not been inserted. The frame bodies (6) have a number of meshes, and can be substituted by equivalent structures, such as pallets. Each of the frame bodies (6) has comer portions each of which is formed with an indentation (61) that matches the shape of the connecting seat (3) such that the connecting seat (3) can butt against the corresponding indentation (61). The indentation (61) is provided with an L-shaped hook 62.

Figure 2:
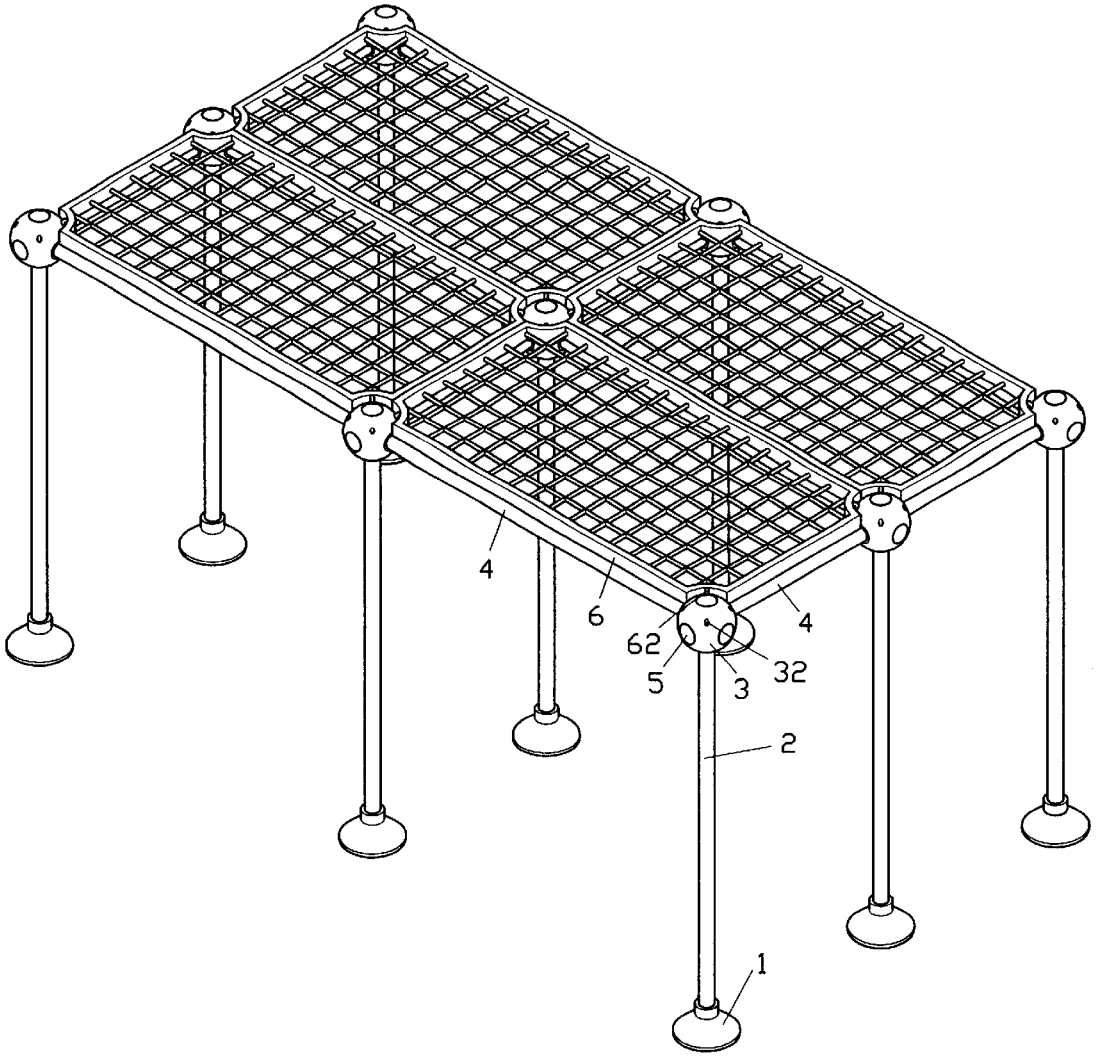
FIG. 2 is a schematic view of a frame assembly of the present invention.
Figure 3:
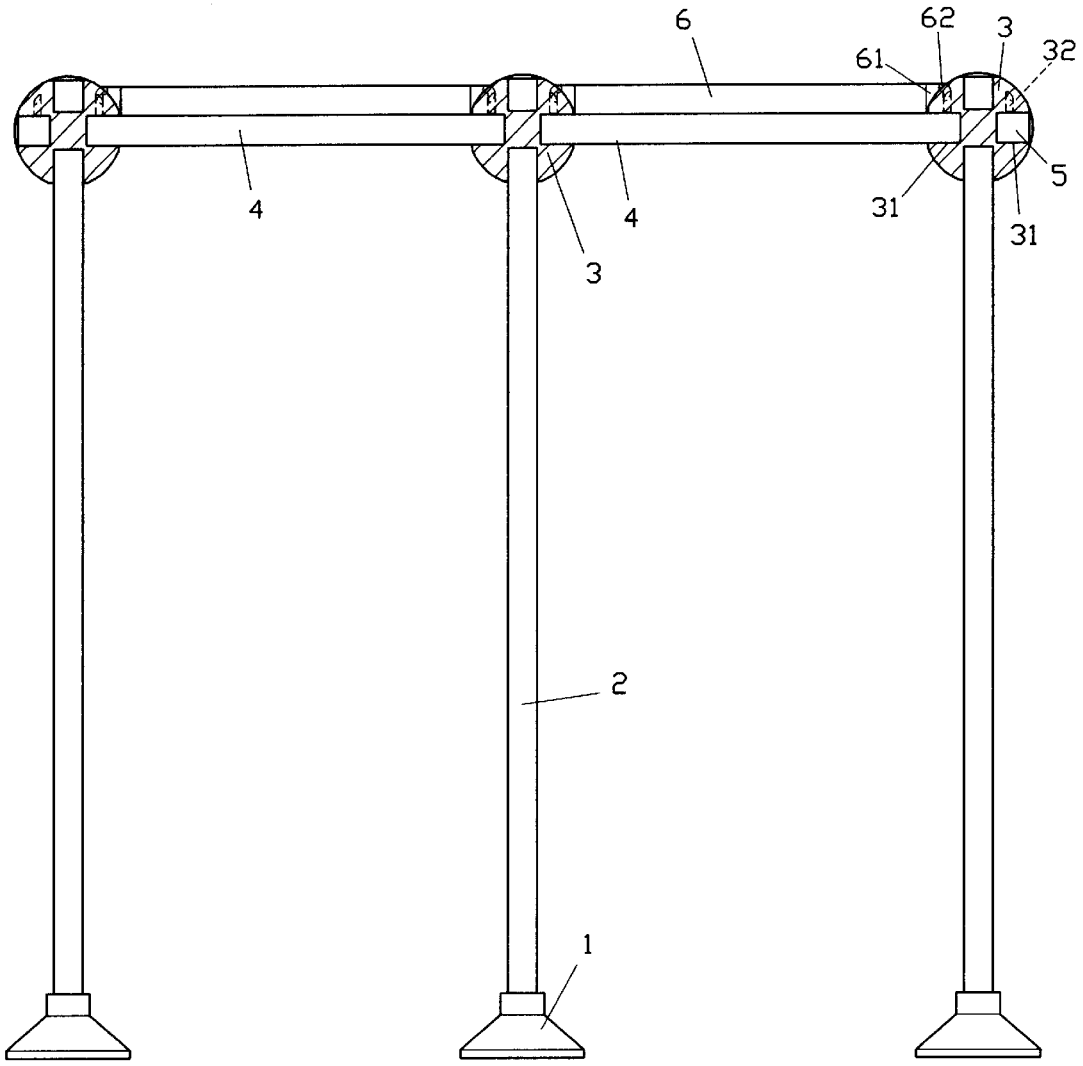
FIG. 3 is a sectional schematic view of the frame assembly of the present invention.
Figure 4:
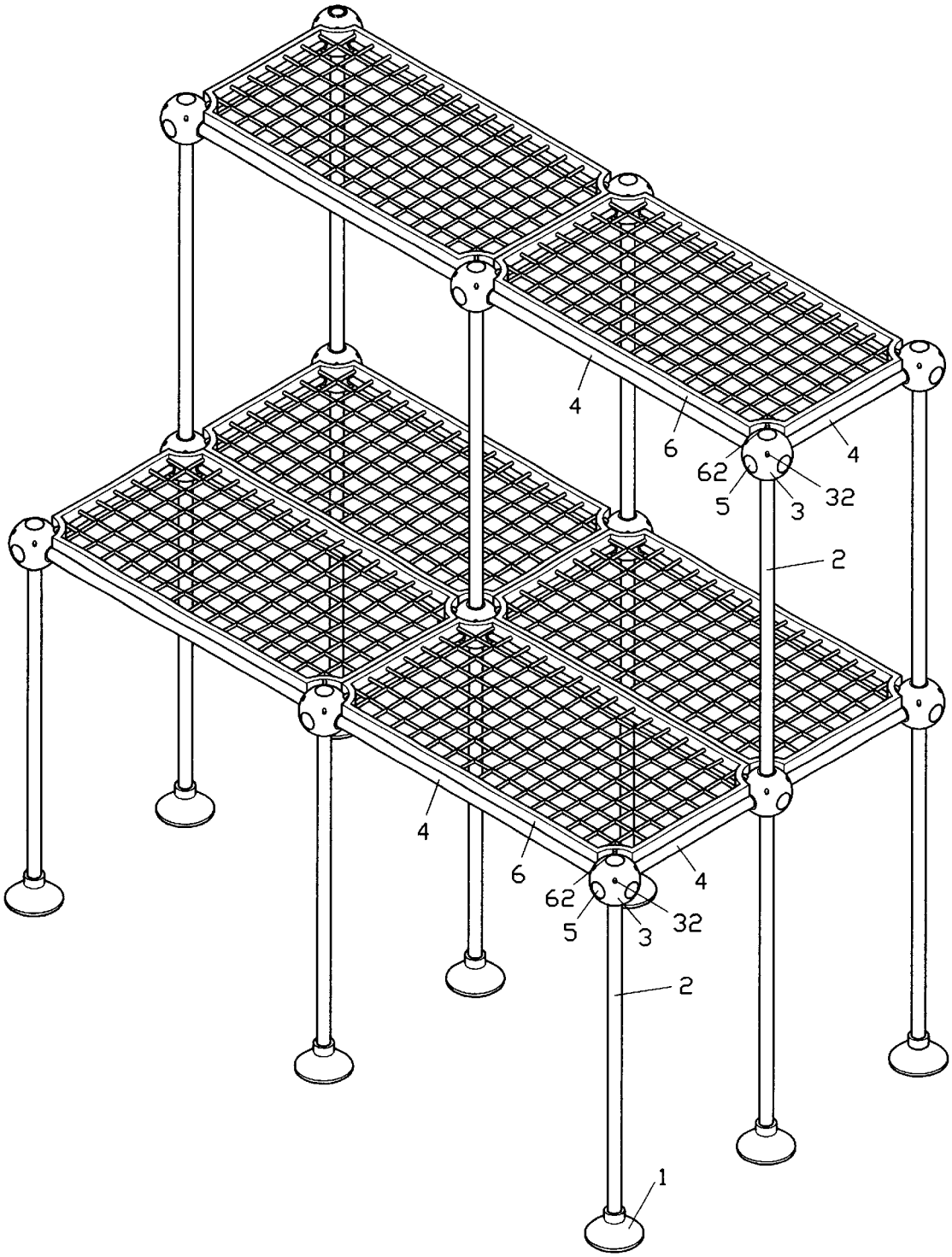
FIG. 4 is a schematic view of another example of the frame assembly of the present invention.

During assembly, with reference to FIGS. 2 and 3, upright rods (2) are inserted into the holes (11) of the bases (1) in an upright position. Each of the connecting seats (3) has to insert slots (31) in the bottom faces along the Z-axis fitting to the top ends of the corresponding upright rod (2). By utilizing the appropriate insert slots (31) along the X & Y axes of the connecting seats (3), the support rods (4) are connected along a horizontal direction to form frame structures of a suitable width and height. In addition, the frame bodies (6) are placed in the frame structures, thus, forming the indentations (61) at the corner portions of the frame bodies (6) butting against the corresponding connecting seat (3), and with the hooks (62) at the indentations (61) enteing the insert holes (32) on the top sides of the connecting seats (3), so that the upright rods (2) and the connecting seats (3) will not move the frame bodies (6) to become disengaged. In addition, as shown in FIG. 4, the insert slots (31) at the top end of the Z-axis of each of the connecting seats (3) may receive another upright rod (2) (or a support rod (4) of the same diameter) to permit construction of additional tier or tiers of the fame bodies (6). The cap plugs (5) used for concealing the insert slots (31) that do not receive any support rods (4) not only makes the invention appear pleasing, they also prevent the entry of foreign objects into the insert slots (31).

Although the present invention has been illustrated and described with reference to the preferred embodiment thereof, it should be understood that it is in no way limited to the details of this embodiment, but is capable of numerous modifications within the limits of the appended claims.

What is claimed is:

1. A movable type frame assembly comprising upright rods, connecting seats, support rods, and meshed frame bodies, wherein each of the connecting seats has end portions provided with insert slots along X, Y, and Z-axes, and the connecting seats being further provided with a vertical insert hole corresponding to a position between two adjacent ones of the insert slots;

the frame bodies have corner end portions each of which is provided with an indentation and a hook;

a Z-axis insert slot of said connecting seat receives the top end of a upright rod, whereas X & Y-axes insert slots receive support rods in a transverse direction, the frame body on a frame structure constituted by the support rods, with indentations butting against the connecting seats and with the hooks engaging and inserting holes of the connecting seats, and the other Z-axis slot of the connecting seat being capable of receiving another upright rod.

2. A movable type frame assembly as defined in claim 1, wherein upright rods and support rods are rods of appropriate lengths and having the same diameter.

3. A movable type frame assembly as defined in claim 1, wherein a lower end of each of the upright rods may be connected to a base, and the base has a vertical hole in the top face for receiving the upright rod.

4. A movable type frame assembly as defined in claim 1, wherein the insert slots of each of the connecting seats are concealed with cap plugs when not connected to support rods, the cap plugs being shaped to have a diameter corresponding to an inner diameter of the insert slots of the connecting seats.

5. A movable type frame assembly as defined in claim 1, wherein the connecting seats are spherical.

* * * * *